US008312886B2

(12) United States Patent
Mishra et al.

(10) Patent No.: US 8,312,886 B2
(45) Date of Patent: Nov. 20, 2012

(54) ORAL TOBACCO PRODUCT HAVING A HYDRATED MEMBRANE COATING AND A HIGH SURFACE AREA

(75) Inventors: Munmaya K. Mishra, Richmond, VA (US); William R. Sweeney, Richmond, VA (US); Shengsheng Liu, Richmond, VA (US); Dennis Geib, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 137 days.

(21) Appl. No.: 12/222,235

(22) Filed: Aug. 5, 2008

(65) Prior Publication Data

US 2009/0038631 A1 Feb. 12, 2009

Related U.S. Application Data

(60) Provisional application No. 60/935,389, filed on Aug. 9, 2007.

(51) Int. Cl.
*A24B 15/00* (2006.01)

(52) U.S. Cl. ..... 131/352

(58) Field of Classification Search ..... 131/352
See application file for complete search history.

(56) References Cited

U.S. PATENT DOCUMENTS

| | | | |
|---|---|---|---|
| 865,026 | A | 11/1907 | Ellis |
| 904,521 | A | 11/1908 | Ellis |
| 1,376,586 | A | 5/1921 | Schwartz |
| 4,513,756 | A | 4/1985 | Pittman et al. |
| 4,543,370 | A | 9/1985 | Porter et al. |
| 4,545,392 | A | 10/1985 | Sensabaugh, Jr. et al. |
| 4,624,269 | A | 11/1986 | Story et al. |
| 4,683,256 | A | 7/1987 | Porter et al. |
| 4,817,640 | A | 4/1989 | Summers |
| 4,917,161 | A | 4/1990 | Townend |
| 4,975,270 | A | 12/1990 | Kehoe |
| 5,092,352 | A | 3/1992 | Sprinkle, III et al. |
| 5,175,277 | A | 12/1992 | Rakitsky et al. |
| 5,387,416 | A | 2/1995 | White et al. |
| 6,162,516 | A | 12/2000 | Derr |
| 6,325,859 | B1 | 12/2001 | De Ross et al. |
| 7,032,601 | B2 | 4/2006 | Atchley et al. |
| 2003/0224090 | A1 | 12/2003 | Pearce et al. |
| 2004/0118421 | A1 | 6/2004 | Hodin et al. |
| 2004/0118422 | A1 | 6/2004 | Lundin et al. |

(Continued)

FOREIGN PATENT DOCUMENTS

| | | | |
|---|---|---|---|
| WO | WO 03/053175 | A | 7/2003 |

(Continued)

OTHER PUBLICATIONS

International Preliminary Report on Patentability issued Feb. 9, 2010 for PCT/IB2008/002883.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

Provided is a moist smokeless tobacco product including a hydrated membrane coating and a portion of tobacco material. Preferably, the tobacco material is pre-portioned and formed to include at least one dimple and/or at least one hole through the tobacco material so as to increase the surface area of the tobacco product.

20 Claims, 1 Drawing Sheet

U.S. PATENT DOCUMENTS

| | | | | |
|---|---|---|---|---|
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0003048 | A1 | 1/2005 | Pearce et al. | |
| 2005/0061339 | A1 | 3/2005 | Hansson et al. | |
| 2005/0067726 | A1 | 3/2005 | Yan et al. | |
| 2005/0100640 | A1 | 5/2005 | Pearce | |
| 2005/0244521 | A1 * | 11/2005 | Strickland et al. | 424/751 |
| 2006/0073190 | A1 | 4/2006 | Carroll et al. | |
| 2006/0144412 | A1 | 7/2006 | Mishra et al. | |
| 2006/0191548 | A1 | 8/2006 | Strickland et al. | |
| 2007/0003663 | A1 | 1/2007 | Jani et al. | |
| 2007/0012328 | A1 | 1/2007 | Winterson et al. | |
| 2007/0062549 | A1 | 3/2007 | Holton, Jr. et al. | |
| 2007/0122455 | A1 | 5/2007 | Myers et al. | |
| 2007/0186844 | A1 | 8/2007 | Weisleder et al. | |
| 2007/0186941 | A1 * | 8/2007 | Holton, Jr. et al. | 131/352 |
| 2007/0186942 | A1 * | 8/2007 | Strickland et al. | 131/361 |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0173317 | A1 | 7/2008 | Robinson et al. | |
| 2008/0202533 | A1 | 8/2008 | Mishra et al. | |
| 2009/0038631 | A1 | 2/2009 | Mishra et al. | |
| 2009/0301505 | A1 | 12/2009 | Liu et al. | |

FOREIGN PATENT DOCUMENTS

| | | |
|---|---|---|
| WO | WO2006/004480 | 1/2006 |
| WO | WO2006/065192 | 6/2006 |
| WO | WO2006/105173 | 10/2006 |
| WO | WO 2008/059375 A | 5/2008 |

OTHER PUBLICATIONS

International Search Report and Written Opinion dated Mar. 30, 2009 for PCT/IB2008/002883.

International Preliminary Report on Patentability and Written Opinion dated May 19, 2009 for PCT/IB2007/004216.

International Search Report and Written Opinion dated Sep. 17, 2008 for PCT/IB2007/004216.

International Search Report and Written Opinion mailed Aug. 25, 2009 for PCT/IB2009/000385.

U.S. Appl. No. 12/576,986, filed Oct. 9, 2009.

U.S. Appl. No. 12/790,043, filed May 28, 2010.

U.S. Appl. No. 12/748,272, filed Mar. 26, 2010.

International Preliminary Report on Patentability issued Aug. 10, 2010 for International Application No. PCT/IB2009/000385.

* cited by examiner

ORAL TOBACCO PRODUCT HAVING A HYDRATED MEMBRANE COATING AND A HIGH SURFACE AREA

CROSS-REFERENCE TO RELATED APPLICATIONS

This application claims priority under 35 U.S.C. 119 to U.S. Provisional Application No. 60/935,389 entitled ORAL TOBACCO PRODUCT HAVING A HYDRATED MEMBRANE COATING AND A HIGH SURFACE AREA and filed on Aug. 9, 2007, the entire content of which is hereby incorporated by reference.

BACKGROUND

Many adult tobacco consumers enjoy chewing flavored and unflavored tobacco with high moisture levels. The moisture of the product provides good flavor and is comfortable in the mouth. In addition, the moisture also allows a user to portion the tobacco product and maintain coherence of the portion during placement.

However, portioning moist tobacco with the fingers is often messy and can disperse the tobacco product in the mouth to some extent.

Pouched tobacco products are available, but many users find the pouches to be uncomfortable due to the texture of the material used to form the pouch. Also, many users feel that the pouch material causes a reduction in the overall flavor of the product and a slow initial flavor release upon insertion in the user's mouth.

Often, the pouched products are small and provide less tobacco than a user of loose tobacco typically desires. Therefore, some users place multiple pouches in their mouths, thereby exacerbating the discomfort caused by some of the pouch materials.

Thus, there remains a need in the art for a moist tobacco product that provides rapid flavor delivery yet fits comfortably in a user's mouth.

SUMMARY

In one embodiment, a moist tobacco product for oral enjoyment is provided. The tobacco product comprises a hydrated membrane coating; and a tobacco material contained within said hydrated membrane coating. The moist tobacco product includes at least one hole and/or at least one dimple therein.

In another embodiment, a method of forming a moist tobacco product for oral enjoyment having a hydrated membrane coating is provided. A portion of moist tobacco material is formed to include at least one dimple and/or at least one hole. The portion of moist tobacco material is contacted with a polymer solution to form the hydrated membrane coating on the molded moist tobacco material.

DETAILED DESCRIPTION

As described herein, a moist tobacco product has been developed wherein a hydrated membrane coating surrounds a molded shape of moist tobacco. It has been found that some coatings of moist smokeless tobacco exhibit various drawbacks with respect to flavor release and/or ability to contain moist smokeless tobacco. For instance, it has been determined that some coating materials are not comfortable in a user's mouth, while others provide too rapid a flavor release and/or are too dissolvable and allow tobacco to migrate into a user's mouth.

As used herein, the term "hydrated membrane coating" refers to a moist and/or semi-moist coating that can release moisture, flavorants and/or additives. The hydrated membrane coating can include insoluble and/or soluble components.

As used herein, the term "colloidal encapsulated tobacco" refers to tobacco that is encapsulated.

To overcome such drawbacks, a hydrated membrane coating has been developed, which allows the flow of flavor juices from the moist smokeless tobacco and added flavorants, while maintaining coherence of the tobacco and providing a smooth and comfortable mouth feel. Preferably, the moist smokeless tobacco product includes pre-portioned moist smokeless tobacco material contained within the hydrated membrane coating. In a preferred embodiment, the moist smokeless tobacco product includes at least one hole extending through the tobacco material and/or at least one dimple so as to increase the surface area of the tobacco product.

The at least one hole and/or at least one dimple makes the smokeless tobacco product more pliable and moldable when inserted in the mouth because the structure of the tobacco product is weakened by the dimples and/or holes. In addition, the hole and/or dimple increases the surface area of the tobacco product so as to expose more tobacco to saliva and in turn increase flavor delivery to the user. In addition, the larger surface area decreases the mean diffusion length out of the tobacco material so as to also increase flavor delivery. Also, the increased surface area decreases the overall density of the tobacco material allowing for the preparation of a larger smokeless tobacco product with less tobacco material enclosed therein.

Figure 1:
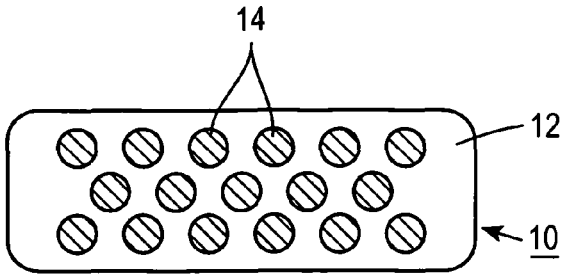
FIG. 1 is a top view of a moist smokeless tobacco product with dimples and a hydrated membrane coating.
Figure 2:
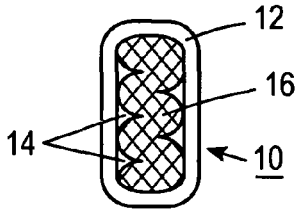
FIG. 2 is a cross-sectional view of the moist smokeless tobacco product of FIG. 1.

As illustrated in FIGS. 1 and 2, preferably, the tobacco product 10 includes a hydrated membrane coating 12 and tobacco material 16. Preferably, the tobacco material 16 is pre-portioned and formed to include dimples 14 that extend partially through the tobacco material 16. Also preferably, the tobacco material 16 is a molded portion of moist snuff tobacco. The dimples 14 can have various shapes such as conical, hemispherical, cylindrical, etc.

As used herein, the term "dimples" includes depressions in the form of waves, folds, cavities, depressions, dents, and/or dips in the tobacco material.

In an embodiment, the dimples 14 are made by altering the surface shape of a portion of tobacco material 16 during molding and/or formation of the tobacco material 16. Preferably, at least one dimple 14 is included. The dimple 14 partially extends into the tobacco material 16. The dimples 14 may be formed in any shape including circles, triangles, lines, squares, oval, and the like. Preferably, the dimples 14 range in size from about 0.1 mm to about 6.0 mm in diameter, more preferably about 0.5 mm to about 2.5 mm. Also preferably, each dimple 14 is less than about 3 mm deep. In a preferred embodiment, at least one dimple 14 can be formed on at least one side of the portion of tobacco material 16. The dimples 14 provide an increase in surface area of the portion of about 0.5% to about 200% as compared to a portion having the same size, but free of such dimples. The dimples 14 also create recesses into the surface of the portion having a volume of about 1% to about 100% of a portion having the same size, but free of such dimples.

Figure 3:
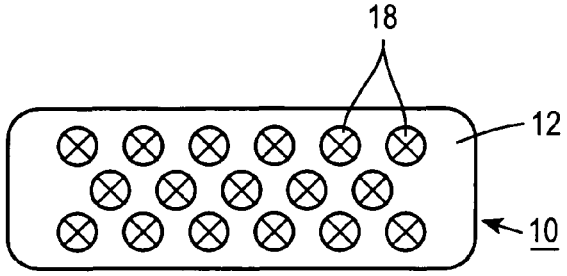
FIG. 3 is a top view of a moist smokeless tobacco product including holes and a hydrated membrane coating.
Figure 4:
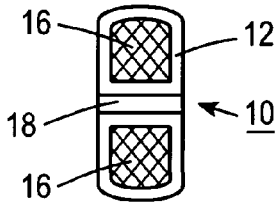
FIG. 4 is a cross-sectional view of the moist smokeless tobacco product of FIG. 3.

Referring now to FIGS. 3 and 4, in a preferred embodiment, the tobacco product 10 includes a hydrated membrane coating 12 over a portion of tobacco material 16. Preferably, the tobacco material 16 is formed to include at least one hole 18 extending through the tobacco material 16. The holes 18 provide an increase in surface area of the portion of about 0.5% to about 200% as compared to a portion having the same size, but free of such holes. The holes also create recesses into the surface of the portion having a volume of about 1% to about 100% of a portion having the same size, but free of such holes.

The holes 18 may be formed with uniform or non-uniform cross-sections in any shape including circles, triangles, lines, squares, oval, and the like. Preferably, the holes 18 range in size from about 0.1 mm to about 6.0 mm in cross-section.

Figure 5:
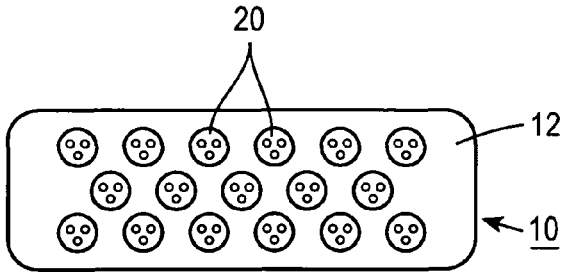
FIG. 5 is a top view of a moist smokeless tobacco product including holes and/or dimples filled with additives.
Figure 6:
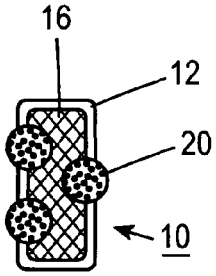
FIG. 6 is a cross-sectional view of the moist smokeless tobacco product of FIG. 5.

Referring now to FIGS. 5 and 6, in a preferred embodiment, the dimples 14 and/or holes 18 in the tobacco material 16 contain additives 20. Preferred additives 20 include non-tobacco flavorants, sweeteners, humectants, chemesthesis agents, tobacco material such as, colloidal encapsulated tobacco and dried tobacco extracts, and/or texturing agents. The additives 20 can be in the form of powders, liquids, emulsions, gels, suspensions, solutions, solids, beads, capsules, microcapsules and the like. The additives 20 can be soluble or insoluble and partially fill, completely fill, or overfill the holes 18 or dimples 14.

In a preferred embodiment, additives 20 in the form of capsules, containing additives, can be embedded in the moist tobacco material 16 after application of the hydrated membrane coating 12, such that the capsules are pushed through the hydrated membrane coating 12 and into the moist tobacco material 16. In an embodiment, the capsules can partially displace the hydrated membrane coating 12 and/or tobacco material 16. In another embodiment, the capsules are embedded in the moist tobacco material 16 before application of the hydrated membrane coating 12. Preferably, the moist tobacco product includes about 1 capsule to about 100 capsules. Preferably, the capsules rupture when placed in the mouth due to mechanical action, dissolution, and/or pH change. Also preferably, the capsules offer controlled release of additives 20.

Figure 7:
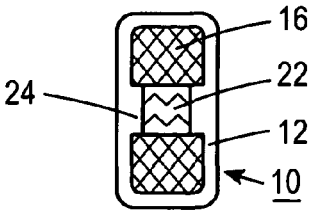
FIG. 7 is a cross-sectional view of a moist smokeless tobacco product including holes and/or dimples filled with additives that are sealed by the hydrated membrane coating.
Figure 8:
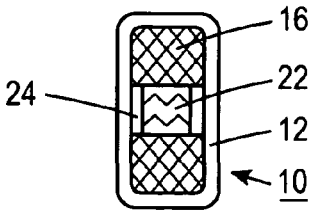
FIG. 8 is a cross-sectional view of a moist smokeless tobacco product including holes and/or dimples filled with additives that are sealed by a seal prior to the application of the hydrated membrane coating.

Referring now to FIG. 7, when liquids, semi-liquids, and/or gels 22 are placed in the dimples 14 and/or holes 18, the dimples 14 and/or holes 18 can be sealed to prevent the additive from escaping. The seals 24 may be formed by the hydrated membrane coating 12. Alternatively, as shown in FIG. 8, a separate seal 24 can be applied prior to application of the hydrated membrane coating 12. Preferably, the seal is dissolvable in the mouth, partially dissolvable, and/or frangible due to mechanical forces.

Preferably, the tobacco product 10 is sized and configured to fit comfortably between the user's cheek and gum. The tobacco product 10 may be formed in many shapes including, without limitation, spheres, rectangles, oblong shapes, crescent shapes, ovals, and cubes.

In a preferred embodiment, the hydrated membrane coating 12 completely covers the pre-portioned tobacco material 16. In another embodiment, the hydrated membrane coating 12 partially covers the pre-portioned tobacco material 16. In an embodiment, the hydrated membrane coating 12 conforms to the dimples 14 or holes 18.

Also preferably, the hydrated membrane coating 12 allows the tobacco juices and flavors to leach out of the hydrated membrane coating 12, while still remaining intact to hold the tobacco within the coating through the duration of tobacco use. The hydrated membrane coating 12 provides a soft compliant feel to the tongue and mouth tissues.

In an embodiment, the hydrated membrane coating 12 is semi-dissolvable and can be prepared from a multi-component polymer as disclosed in United States Provisional Patent Application No. 60/858,951, the entire content of which is incorporated by reference. For example, the hydrated membrane coating 12 can include pectin, alginate, and dextrin. In a preferred embodiment, a monolayer, hydrated membrane coating 12 can be used to enclose a portion of moist tobacco by coating the tobacco with a film-forming polymer solution.

In a preferred embodiment, the hydrated membrane coating 12 is a single layer coating that coats a portion of a tobacco material 16 with at least one soluble component and at least one insoluble component. Preferably, the soluble component includes at least one polymer that is a soluble, non-cross-linkable polymer. Also preferably, the insoluble component includes at least one polymer that is an insoluble, cross-linkable polymer.

The hydrated membrane coating 12 is porous to some extent, but preferably creates a porous network of the at least one insoluble polymer after the soluble component dissolves in a user's mouth. Preferably, the soluble component dissolves rapidly in a user's mouth such that the insoluble component remains intact throughout use of the tobacco product.

Once the soluble component of the hydrated membrane coating 12 dissolves, pores are created in a polymer network through which the tobacco juices and flavors flow. Flavors and water are released into the user's mouth as the soluble component of the hydrated membrane coating 12 dissolves. The tobacco flavors and juices are then released through the pores so that the flavor experience is continuous from beginning to end. In a preferred embodiment, the bulk density of the coated tobacco product is about $1.0 \pm 0.2$ g/cm$^3$.

Preferably, the pores, created when the soluble component of the hydrated membrane coating 12 dissolves, are large enough to allow the unencumbered flow of juices, while remaining small enough to prevent shreds or particles of tobacco from traveling through the pores and into the user's mouth. Because the soluble component of the hydrated membrane coating 12 dissolves quickly, the sensory experience associated with moist tobacco use is rapid and unencumbered. Once the soluble component of the dissolvable and/or disintegrable hydrated membrane coating 12 dissolves or disintegrates, additional moisture and/or flavors are released into the user's mouth. Thereafter, the flavors and tobacco juices pass through the hydrated membrane coating 12 to provide an uninterrupted flavor experience to the user.

In a preferred embodiment, the multi-component, hydrated membrane coating 12 may be provided with a desired rate of dissolution of the soluble component of the hydrated membrane coating 12 by altering the proportion of the soluble component to the insoluble component.

In a preferred embodiment, the hydrated membrane coating 12 is not messy or sticky to the touch. If both an insoluble and a soluble polymer are used to create the hydrated membrane coating 12, when a user touches the hydrated membrane coating 12, the polymers preferably do not disassociate from one another thus making the hydrated membrane coating 12 non-sticky when the product is removed from a package and placed in the mouth.

The size of the pores, created when the soluble component dissolves, may be altered by patterning the hydrated membrane coating 12 in such a way as to ensure the soluble component is only in certain spots and in certain amounts so that once the soluble component dissolves away the pores are of a desired size.

When a multi-component hydrated membrane coating 12, including more than one polymer, is formed, because moist tobacco naturally contains salts such as calcium ions, the calcium ions preferably cross-link with the cross-linkable polymer to form a skin or shell on the inside of the hydrated membrane coating 12. Later, when the hydrated membrane coating 12 is exposed to a cross-linking agent, an outer skin or shell can form on the hydrated membrane coating 12. The inner and outer skins or shells provide a moisture barrier for the tobacco and the soluble portion of the hydrated membrane coating 12. Preferably, the shells/skins are formed of a discontinuous, cross-linkable polymer with regions of the non-cross-linkable polymer incorporated therein.

When using both a non-cross-linkable polymer and a cross-linkable polymer, the porosity and strength of the hydrated membrane coating 12 can be controlled. For instance, the dissolution rate of the resulting hydrated membrane coating 12 can be altered by modifying the specific proportion of cross-linked to non-cross-linked polymers. In a preferred embodiment, the hydrated membrane coating 12 contains 2 to 90 wt % of the cross-linked polymer. Preferably, the proportion of cross-linked polymer in the hydrated membrane coating 12 is 60 to 70 wt %.

In another embodiment, the polymer solution and the cross-linking solution can be patterned, overprinted, or sprayed onto the tobacco material preform to form a network having a soluble component and an insoluble component. The polymer solution may include a chemically, cross-linkable polymer and a non-cross-linkable polymer.

In alternative embodiments the hydrated membrane coating 12 includes only a soluble component or an insoluble component.

In a preferred embodiment, the single-component hydrated membrane coating 12 is formed by a polymer solution containing an insoluble component having pores mechanically formed therein. Preferably, the insoluble component is a cross-linkable polymer that is cross-linked with a cross-linking agent.

In another embodiment, when the polymer solution includes a single chemically, cross-linkable polymer, the cross-linking solution may be selectively sprayed to leave some portions of the hydrated membrane coating 12 non-cross-linked and soluble. The soluble component of the hydrated membrane coating 12 may dissolve, leaving a porous network of insoluble component in place to maintain coherence of the tobacco material 16, while allowing the free flow of saliva in the user's mouth.

In another embodiment, the hydrated membrane coating 12 can be formed by a soluble component. Preferably, the soluble component is formed by a non-cross-linkable polymer. Also preferably, the insoluble component is formed by a chemically, cross-linkable polymer reacted with a cross-linking agent. Both the cross-linkable and non-cross-linkable polymers may be natural or synthetic. Preferably the polymers are hydrocolloids. More preferably, the polymers are polysaccharides.

In a preferred embodiment, the concentration of the film forming polymer solution is about 0.1 wt % to 20 wt % polymer in the solution. Most preferably, the concentration of the film forming polymer solution is about 1 wt % to 1.5 wt % of the polymer components with the balance being water.

The concentration of the polymer solution determines the thickness of the hydrated membrane coating 12. The thickness of the hydrated membrane coating 12 can in turn affect how quickly the soluble component, if any, of the hydrated membrane coating 12 dissolves in a user's mouth.

When an insoluble component is included in the hydrated membrane coating 12, after coating the tobacco material 16 with the film forming polymer solution, cross-linking is conducted with a cross-linking solution including a monovalent metal ion salt or a bivalent metal ion salt when a cross-linkable polymer is used. While, both monovalent and bivalent metal ion salts may be used, preferably a bivalent metal ion salt is used. Suitable bivalent metal ion salts include, without limitation, calcium lactate, calcium chloride, calcium sorbate, calcium propionate and the like. Calcium lactate is preferred since it is approved for use in food products.

Preferably, the cross-linking solution contains a bivalent metal ion salt. Most preferably, the cross-linking solution includes calcium lactate, which is commonly used in the food industry. In one embodiment, the cross-linking solution is a 2.0 wt % calcium lactate solution.

Suitable non-chemically-cross-linkable polymers include, without limitation, starch, dextrin, gum arabic, guar gum, chitosan, cellulose, polyvinyl alcohol, polylactide, gelatin, soy protein, and whey protein.

Suitable chemically, cross-linkable polymers include, without limitation, alginate, pectin, carrageenan, and modified polysaccharides with cross-linkable functional groups. The preferred cross-linkable polymers are alginate and pectin.

Preferably, the hydrated membrane coating 12 also includes flavors, sweeteners, and/or a chemesthesis agent. The flavors, sweeteners and chemesthesis agents can be released upon dissolution of the soluble component and/or the entire hydrated membrane coating. If slow release of certain flavor additives is desired, such additives can be incorporated in the insoluble component of a bicomponent hydrated membrane coating 12. Preferably, the released flavors enhance the oral sensorial experience of the tobacco product user.

Preferably, the final portioned tobacco product 10 weighs about 1.0 to 3.0 grams. The weight is predominately based on the amount of tobacco material 16 used since the weight of the hydrated membrane coating 12 is small as compared to that of the tobacco material 16. In an embodiment, the shaped tobacco product may be up to about 1.5 inches long, up to 1 inch in height, and up to ¾ inch in width. Preferably, the tobacco product 10 is flexible, compressible, and capable of conforming to the shape of the oral cavity.

Exemplary tobacco materials 16 that may be coated with a hydrated, monolayer hydrated membrane coating 12 can include cut or ground tobacco. Additionally, flavor additives and/or humectants may be included in the tobacco materials 16. The tobacco materials 16 can have the composition and attributes of conventional moist snuff tobacco.

Examples of suitable types of tobacco materials 16 that may be used include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. Preferably, the tobacco material 16 is pasteurized. Some or all of the tobacco material 16 may be fermented.

The tobacco material 16 may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material 16 may also include a supplemental amount of vegetable or plant fibers or particles such as particles of shreds of lettuce, cotton, flax, beet fiber, cellulosic fibers, blends thereof and the like.

In one embodiment, the tobacco material 16 is completely disintegrable so that once the tobacco material has disintegrated, a user may chew and ingest the remaining insoluble component of the hydrated membrane coating 12 so that nothing remains in the user's mouth.

Humectants can also be added to the tobacco material 16 to help maintain the moisture levels in the portioned tobacco product. Examples of humectants that can be used with the tobacco material 16 include glycerol, glycerine, triethylene glycol and propylene glycol. The humectants may also be provided for a preservative effect, as the water activity of the product can be decreased with inclusion of a humectant. In turn, the opportunity for growth of micro-organisms is diminished. Additionally, humectants can be used to provide a higher moisture feel to a drier tobacco component.

Suitable flavor additives and aromas for inclusion in the hydrated membrane coating 12 or the tobacco material 16 include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

Suitable additives contained in the hydrated membrane coating 12, holes 18 and/or dimples 14 include, without limitation, natural or artificial sweeteners. Preferred sweeteners include, without limitation, water soluble sweeteners such as monosaccharides, and disaccharides, such as xylose, ribose, sucrose, maltose, fructose, glucose, and mannose. Polysaccharides may also be included.

Additives such as chemesthesis agents may also be included in the hydrated membrane coating 12, holes 18 and/or dimples 14. Suitable chemesthesis agents for inclusion in the hydrated membrane coating 12 include, without limitation, capsaicin, tannins, mustard oil, wintergreen oil, cinnamon oil, allicin, quinine, citric acid, and salt.

Preferably, the hydrated membrane coating 12 is a moist, gel-like coating when formed and the moistness is preferably retained until use. Also preferably, the coated tobacco product is hermetically sealed in suitable packaging to prevent moisture in the tobacco materials 16 and hydrated membrane coating 12 from evaporating.

If the hydrated membrane coating 12 is peeled off of the tobacco product 10 and completely dried, the hydrated membrane coating 12 is preferably about 0.02 mm to 1.0 mm thick. More preferably, when the hydrated membrane coating 12 is completely dried, it is about 0.08 mm to 0.14 mm thick. In a most preferred embodiment, the hydrated membrane coating 12 when completely dried is about 0.11 mm thick. It should be noted that the hydrated membrane coating 12 is not intended to be dried, but rather retains a high moisture content.

In a preferred embodiment, the weight of the hydrated membrane coating 12 when completely dried is about 0.013 g for a coated tobacco product weighing about 2.5 g. In contrast, the weight of the coating for a coated tobacco product weighing about 2.5 g, when the hydrated membrane coating 12 is at the preferred moisture content is about 0.15 g.

The tobacco product 10 is then exposed to air or patted dry to evaporate excess moisture. The tobacco product 10 is not dried so that moisture content remains high in the hydrated membrane coating 12. Preferably, the moisture content of the tobacco material 16 is about 35% to about 65%.

In an embodiment, tobacco-based polymers may be substituted for non-tobacco sourced materials in the hydrated membrane coating 12. Flavorful tobacco compounds may be extracted from the tobacco based material in order to modify the tobacco flavor character to initial in-mouth experience. However, such high extraction is unnecessary.

In one embodiment, additional dissolvable tobacco such as tobacco extracts or colloidal encapsulated tobacco can be added to the hydrated membrane coating 12 to increase the initial tobacco flavor in the first stages of the dissolution of the hydrated membrane coating 12.

Fillers may be added to the hydrated membrane coating 12 to make it opaque. Colorants may also be added to alter the color of the hydrated membrane coating 12.

While the foregoing has been described in detail with reference to specific embodiments thereof, it will be apparent to one skilled in the art that various changes and modification may be made, and equivalents thereof employed, without departing from the scope of the claims.

What is claimed is:

1. A moist tobacco product for oral enjoyment comprising:
- a hydrated membrane coating comprising:
  - a soluble, non-cross-linked polymeric component; and
  - an insoluble, non-cross-linked polymeric component; and
- a tobacco material contained within said hydrated membrane coating,
- wherein said moist tobacco product includes one of at least one dimple that extends partially through said tobacco material and at least one hole that extends completely through said tobacco material.

2. The moist tobacco product of claim 1, wherein a plurality of holes and/or dimples are arranged in a uniform pattern in said tobacco material.

3. The moist tobacco product of claim 1, wherein a plurality of holes and/or dimples are arranged in a random pattern in said tobacco material.

4. The moist tobacco product of claim 1, wherein said moist tobacco product includes at least one dimple which has a tapered cross-section.

5. The moist tobacco product of claim 1, wherein said at least one hole and/or said at least one dimple extends into a molded portion of moist smokeless tobacco and is filled with a material comprising at least one additive.

6. The moist tobacco product of claim 5, wherein said at least one additive is a liquid, a gel, a semi-liquid, a capsule, a microcapsule and/or a bead.

7. The moist tobacco product of claim 5, wherein said at least one additive is contained in said at least one hole and/or said at least one dimple by a seal.

8. The moist tobacco product of claim 7, wherein said seal is formed by said hydrated member coating.

9. The moist tobacco product of claim 7, wherein said seal is a gel or a film.

10. The moist tobacco product of claim 5, wherein said at least one additive includes at least one non-tobacco flavorant.

11. The moist tobacco product of claim 5, wherein said at least one additive includes: a) at least one sweetener; b) at least one chemesthesis agent; and/or c) a tobacco extract.

12. The moist tobacco product of claim 1, wherein said coating is a food grade coating.

13. The moist tobacco product of claim 1, wherein said at least one hole and/or said at least one dimple provides an increase in surface area of the tobacco material of about 0.5% to about 200% as compared to tobacco material having the same size, but free of said at least one hole and/or said at least one dimple.

14. The moist tobacco product of claim 1, wherein said at least one hole and or at least one dimple forms a recess in the surface of the tobacco material having a volume of about 1% to about 25% of the tobacco material as compared to tobacco material having the same size, but free of said at least one hole and/or at least one dimple.

15. The moist tobacco product of claim 1, wherein the hydrated membrane coating is moist or semi-moist semi-dissolvable coating.

16. The moist tobacco product of claim 1, wherein the moist tobacco product has a moisture content of about 35% to about 65%.

17. A moist tobacco product for oral enjoyment comprising:

a hydrated membrane coating comprising:

a soluble, non-cross-linked polymeric component; and an insoluble, non-cross-linked polymeric component; and a tobacco material contained within said hydrated membrane coating, wherein said tobacco material is rhomboid in shape and at least one hole extends between opposed surface of said tobacco material.

18. A method of forming a moist tobacco product for oral enjoyment having a hydrated membrane coating comprising:

forming a portion of moist tobacco material to include one of at least one dimple that extends partially through said tobacco material, and at least one hole that extends completely through said tobacco material; and contacting said portion of moist tobacco material with a polymer solution to form the hydrated membrane coating on the molded moist tobacco material, the hydrated membrane coating comprising a soluble, non-cross-linked polymeric component and an insoluble, cross-linked polymeric component.

19. The method of claim 18, further including placing at least one additive in said at least one hole and/or said at least one dimple.

20. The method of claim 18, further including sealing said at least one hole and/or said at least one dimple with a food grade sealant to contain said at least one additive therein.

* * * * *